United States Patent [19]

Constantinescu

[11] 4,187,654

[45] Feb. 12, 1980

[54] VACUUM SYSTEM FOR SWIMMING POOLS

[76] Inventor: Spiridon Constantinescu, 161 Violet Dr., Stoney Creek, Ontario, Canada, L8E 3J2

[21] Appl. No.: 882,943

[22] Filed: Mar. 2, 1978

[51] Int. Cl.[2] ..... E02D 27/00; E04H 12/20

[52] U.S. Cl. ..... 52/169.7; 4/172.15

[58] Field of Search ..... 4/172, 172.15; 52/169.7, 169.14, 742, 743, 746; 248/362, 363

[56] References Cited

U.S. PATENT DOCUMENTS

| | | | |
|---|---|---|---|
| 3,512,487 | 5/1970 | Kranz et al. | 248/363 |
| 3,991,530 | 11/1976 | Scourtes | 52/169.7 |
| 4,027,442 | 6/1977 | Silverman | 52/169.7 |

*Primary Examiner*—Lowell A. Larson

[57] ABSTRACT

The customary method to prepare the pool bottoms in order to install the vinyl liners is with even, smooth surfaces. Difficulties occur when draining a vinyl liner pool in order to change the water, repair the liner, clean the grease from the liner, or remove the impurities from the pool bottom.

In the method which I propose, the pool bottom is finished with plastic or rubber tiles which are pitched in the ground. The upper surface of the tiles is deeply impressed with geometrical designs and cramped channels which allow flow of the underliner air towards a permanent vacuum system at any time. Thus, whenever it is necessary, the liner is sucked to the pool bottom by higher pressures than the normal water pressure of the pool, and the liner maintains its shape firmly until the pool is able to be refilled.

2 Claims, 12 Drawing Figures

VACUUM SYSTEM FOR SWIMMING POOLS

This improvement relates to a system which prepares the pool bottom with special plastic or rubber tiles and a vacuum network system before installing the vinyl liner.

It is known that vinyl liners installed on pool bottoms are prepared in even, smooth surfaces. Usually the bottom finishes of pools are: tamped and trowelled sand to uniform smoothness, sand plus foam board or composition board, pool pad cement, or reinforced concrete. The liner is installed by sucking it into place using commercial vacuum cleaners. Prior to installing the liner the sources of air leaks must be reduced. A small section of the liner is opened up beading just large enough to insert the vacuum hose. The gap is closed with wet rags to prevent air leakage around the hose. Turning the vacuum on to pump out the air, the liner will be sucked in place and at the same time the final adjustments to the liner for removing wrinkles can be made. When the liner is well sucked in place, filling the pool with water can start. Further a precautions should be taken when draining a vinyl liner pool for different reasons. New vinyl is very flexible and stretchy at first, but as it ages it loses some stretchability and tends to shrink. The powerful water pressure prevents any change in shape of the liner as long as the water remains in the pool, but if the water is removed for any length of time, the liner will shrink. For these reasons the instructions forbid the removal of the water from a pool unless absolutely necessary and replacement of water as soon as possible. When the water has to be changed, the instructions advise only to change it down to the 42" mark without disturbing the fit in the hopper section. No matter how high the quality and maintenance of a pool skimmer-filter system is, it can not replace a periodical complete change with fresh water. In the course of time the vinyl liner becomes dirty and it must be cleaned and degreased, and impurities heavier than water will lie on the bottom so the pool must be emptied. Also the pool bottom must be emptied and dried when the liner needs to be repaired. These necessities of emptying are in opposition with the actual instructions and requirements to save the vinyl liner.

I have found that these disadvantages may be overcome. It is possible to keep the vinyl liner sucked on the pool bottom when the pool needs to be emptied. For vinyl liner pools, it is possible to accomplish a vacuum network system when the pool hole is excavated and before the pool bottom preparation. The vacuum network system connects each plane of the bottom and is able to suck the air apart from each plane, the planes being separated between them by smooth stripes. Every bottom plane is paved with plastic or rubber tiles, their upper surfaces being deeply impressed with geometrical designs and cramped channels between them to allow the flowing of the vacuumed air. The tiles are fixed in the ground by plastic nails. Every bottom plane has one or more tiles connected to the vacuum network system by special drain pipes which fix these tiles in the ground instead of plastic nails. When the pool needs to be emptied, the network is connected to a device called separator which is capable of separating air from water, and to a vacuum pump. If the vinyl liner is torn somewhere, the torn plane is isolated from a gate valve and the liner of this plane will not be sucked in rendering it useless. The vacuum system can exert higher forces on the liner than the pool water forces. These pressures are maintained automatically by a vacuum pump starter activated by limited pressures until the work is completed. So it is possible to change the water periodically, to repair the liner, to clean up the liner of dirt and grease, and to remove the impurities from the pool bottom, without endangering or compromising the vinyl liner. It is not necessary to purchase the separator and the vacuum pump, because service stations can bring them and perform the job when required.

These and other objects and advantages of this invention will become apparent from the following specification and accompanying drawings, wherein.

Figure 1:
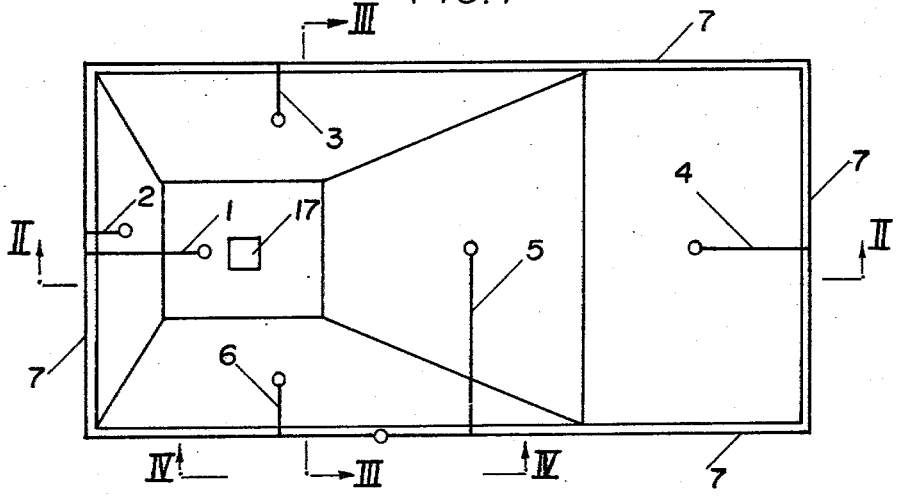
FIG. 1 is a top plan view of the excavated hole of the pool and the permanent vacuum network system.
Figure 2:
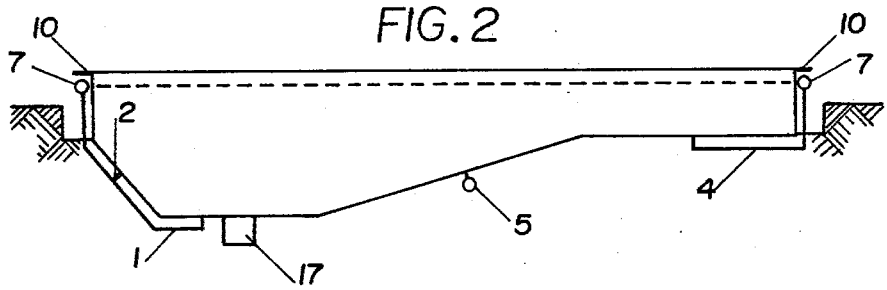
FIG. 2 is a cross section of the line II—II of FIG. 1.
Figure 3:
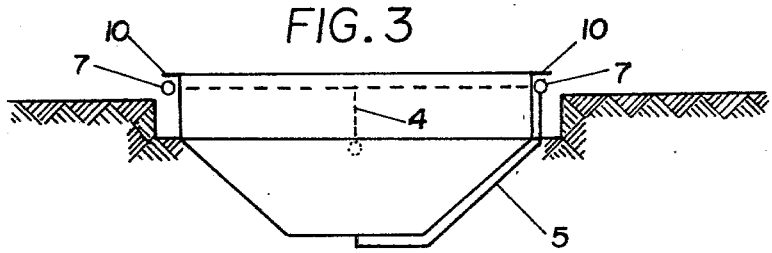
FIG. 3 is a cross section of the line III—III of FIG. 1.
Figure 4:
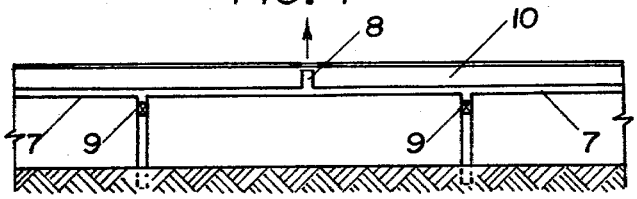
FIG. 4 is a lateral view of FIG. 1 as the line IV—IV shows.
Figure 5:
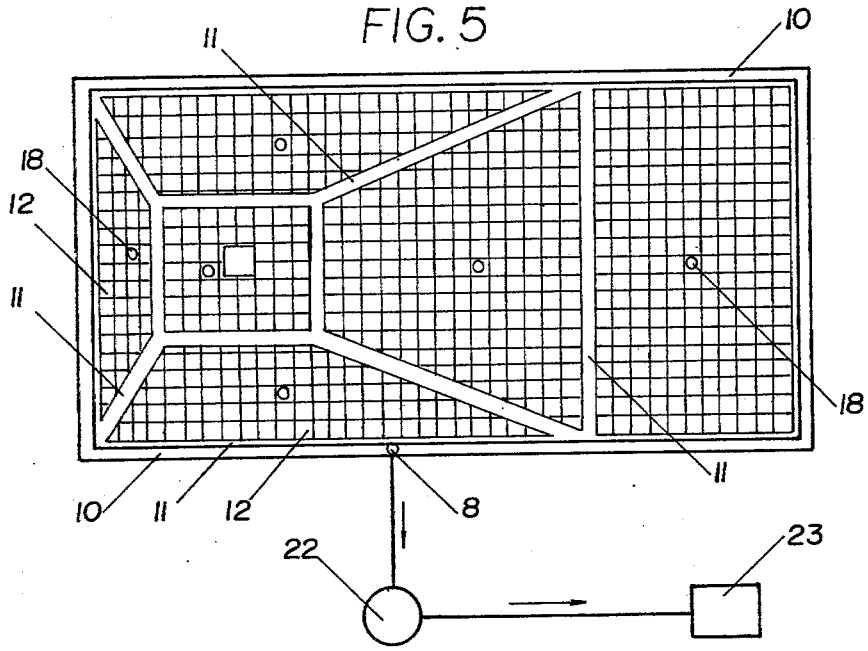
FIG. 5 is a top plan view of the finished pool before installing the vinyl liner, connected to separator and vacuum pump.
Figure 6:
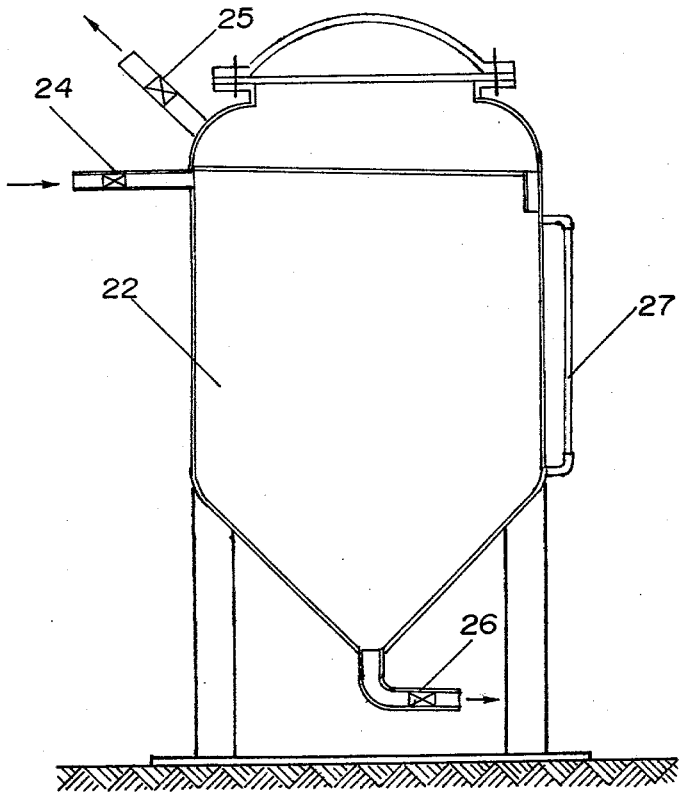
FIG. 6 is a cross section through the separator.
Figure 7:
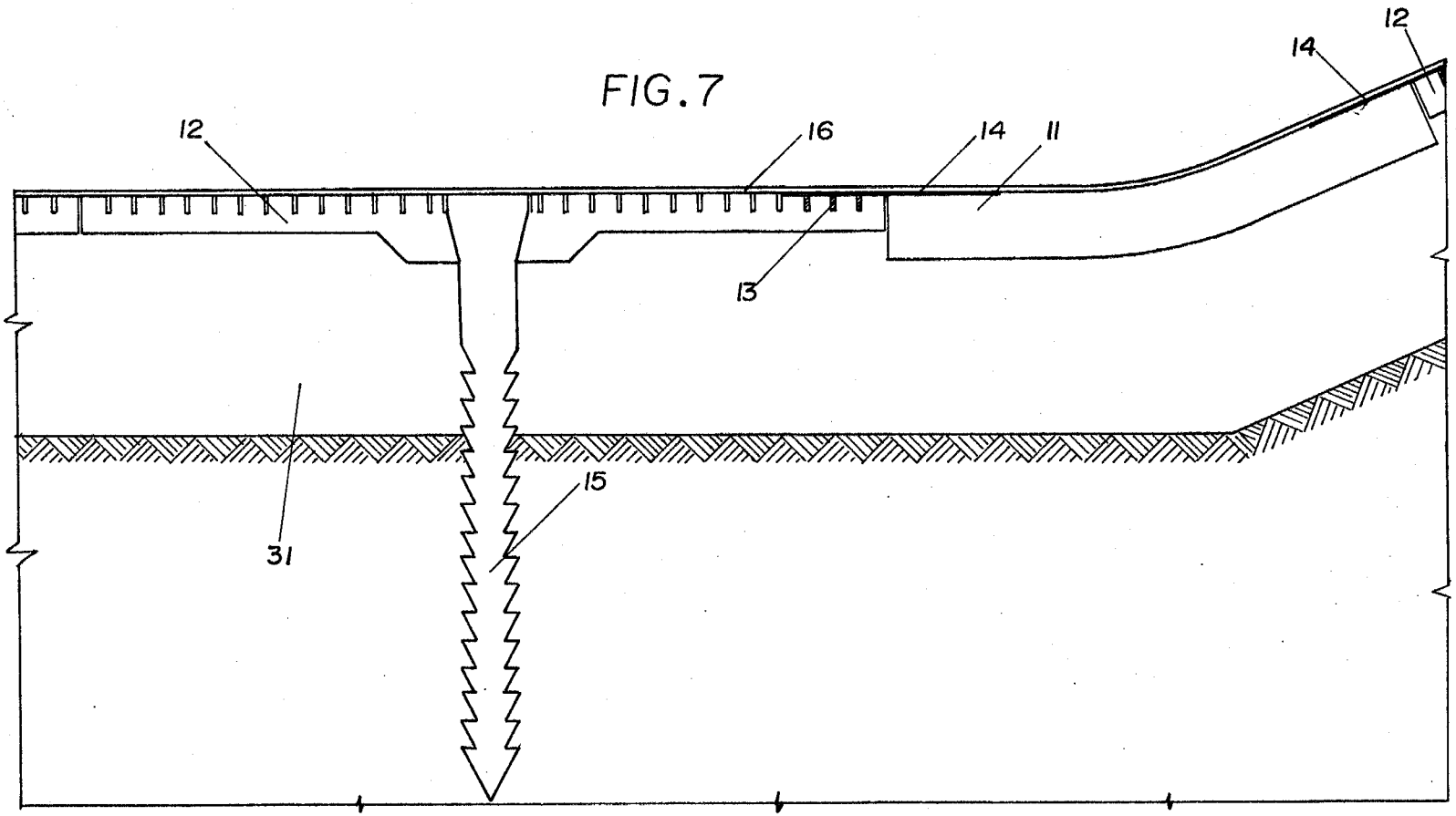
FIG. 7 is a partial cross section of the hopper.
Figure 8:
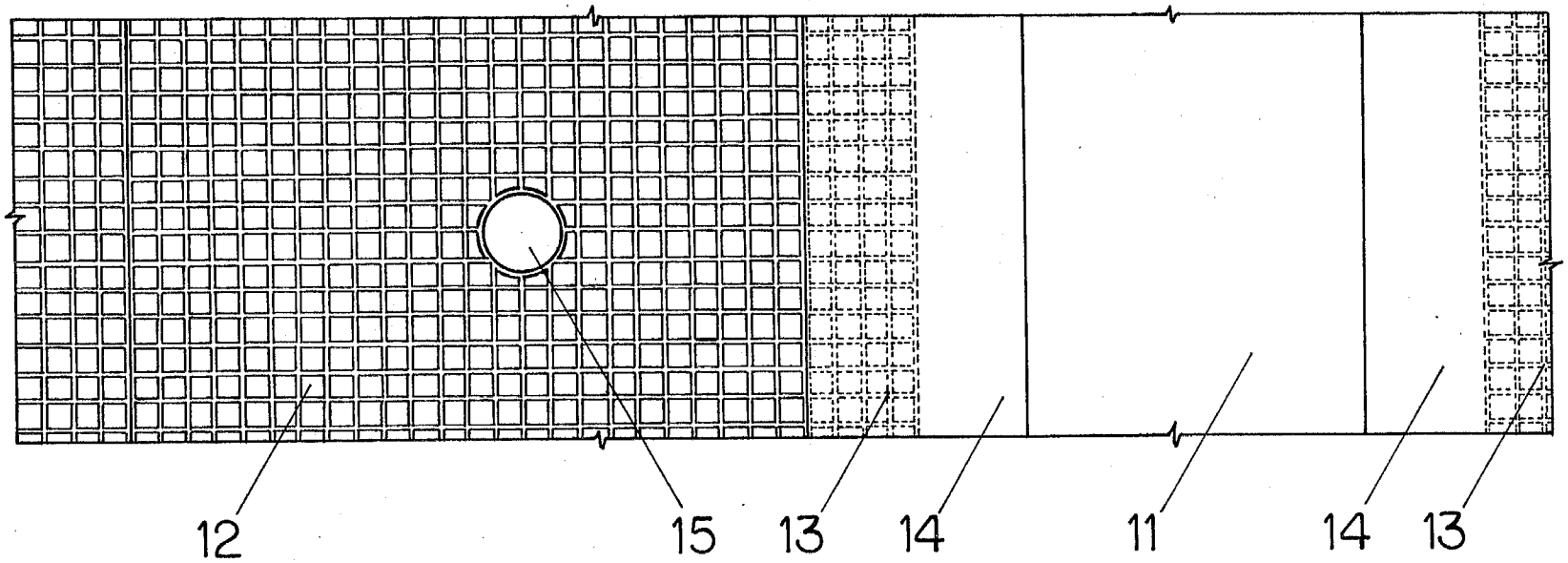
FIG. 8 is a top plan view of FIG. 7 without the vinyl liner.
Figure 9:
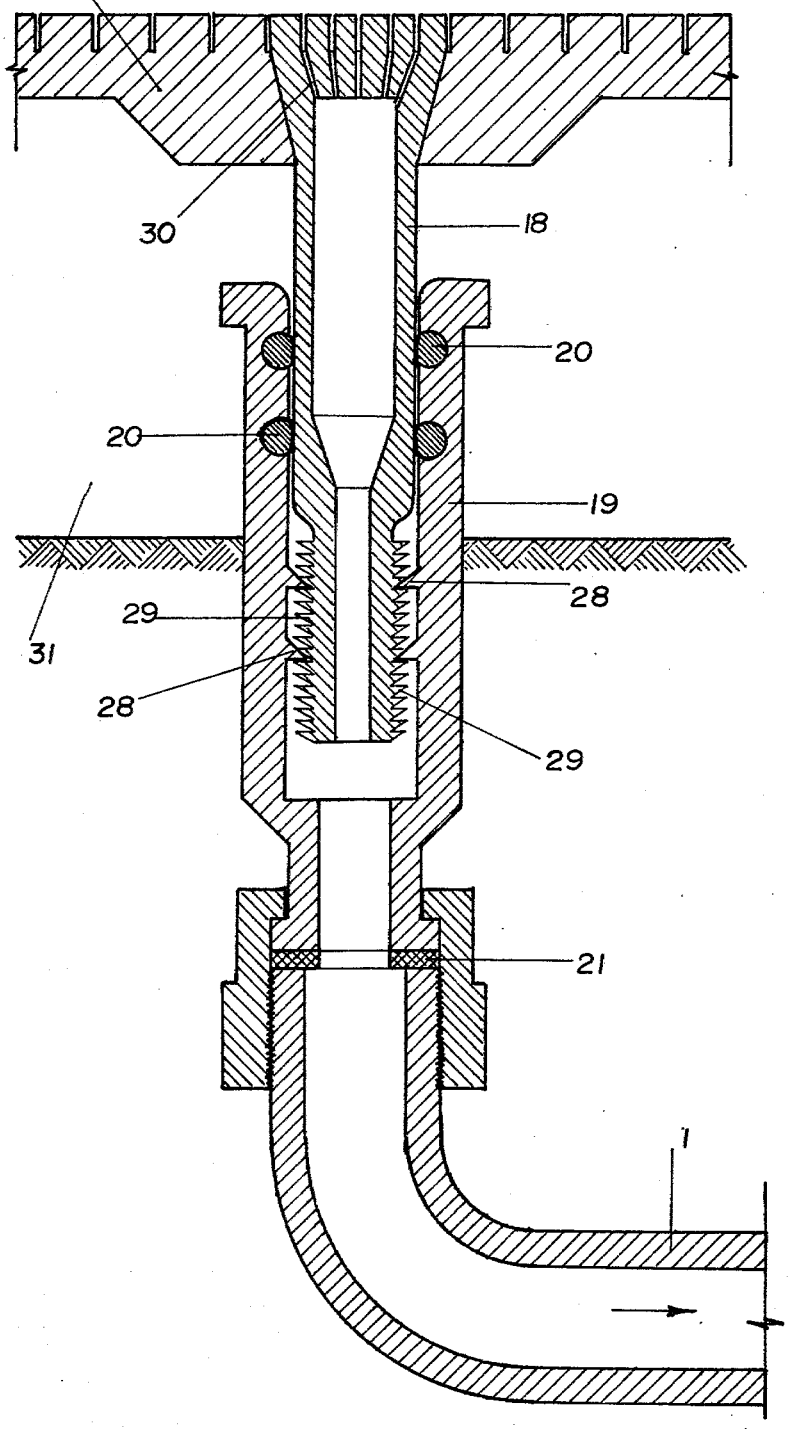
FIG. 9 is a cross section displaying a connection between a tile and the vacuum network system.
Figure 10:
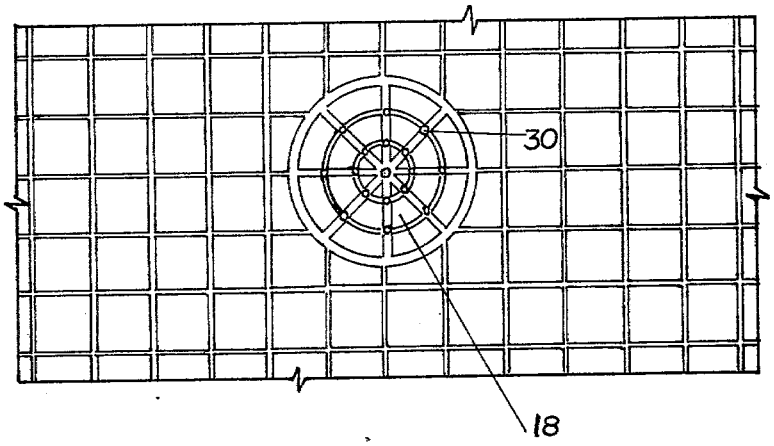
FIG. 10 is a top plan view of FIG. 9, the geometrical design impressed on the tiles being squarer.
Figure 11:
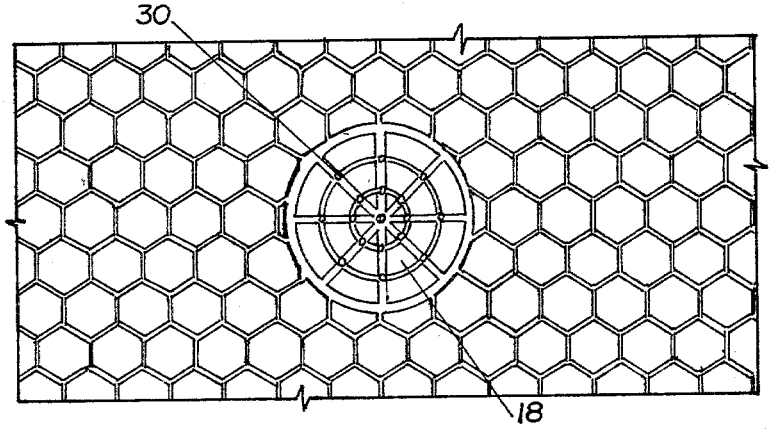
FIG. 11 is similar to FIG. 10 where the design is hexagonal.
Figure 12:
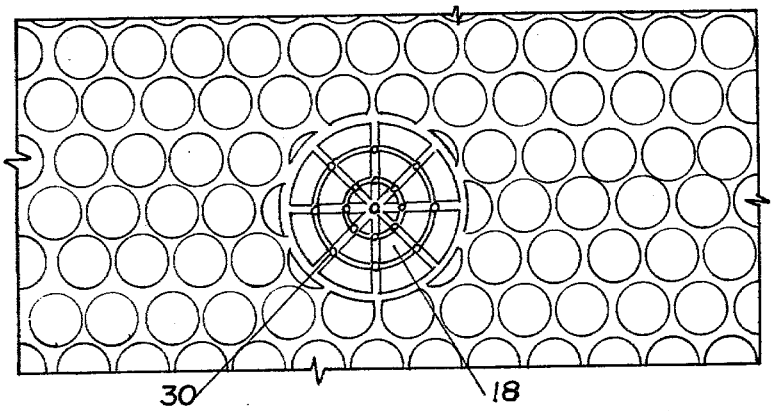
FIG. 12 is similar to FIG. 10 where the design is circular.

When the perfect sides and floor measurements of the pool have been achieved, the vacuum network will be installed concomitantly with the main drain 17, and the plumbing FIGS. 1, 2. The vacuum network connects each plane of the pool bottom to the upper surrounding pipe 7, FIGS. 1, 2, 3, 4 through the pipes 1, 2, 3, 4, 5, 6, FIG. 1. The pipes are buried in the ground about 5". Pipe 8 FIG. 4 connects the network to the separator and vacuum pump. The accomplished network is pressure tested to insure an absolute reliability. Then the network is plugged. The pool bottom can be of any finish, but the sand bottom finish is the cheapest and the most suitable. The smoothness and evenness of the bottom sand will not be determinant for the liner. The bottom is shaped with a thin layer of about 2" of sand 31, FIGS. 7, 9, into the distinct geometric pattern of the pool. The sand bottom will be paved with plastic or rubber tiles and styrofoam or foaming-rubber stripes. Tiles 12, FIGS. 5, 7, 8, have their surfaces deeply impressed with geometrical designs. The designs can be squarer as in FIG. 10, hexagonal as in FIG. 11, circular as in FIG. 12, or any other regular geometrical figure either polygonal or curvilinear. The channels of the tiles are cramped enough to allow the movement of the vacuum air but the vinyl liner is protected against puncture. This means that the channels can have a width of 1/32" to 1/64". The tiles are used to pave the different planes of the bottom. The styrofoam or foaming-rubber stripes 11, FIGS. 5, 6, 7, are placed on the corners and edges separating the bottom planes between them, and rounding the sharpness of the border. First, the tiles connecting the bottom planes to the vacuum network system are placed. Each plane is connected by a minimum of one tile to a pipe of the vacuum network FIGS. 5, 9, 10, by means of the drain pipes 18 and 19, FIG. 9. The drain pipes 18 and 19 are flexible and air-tight connected between them by means of the gaskets 20 and 21 and the elastic blades 29 and rigid ribs 28, FIG. 9. The next step is the laying of the tiles 12, FIGS. 5, 7, 8. A pattern iron tile is tamped until its mark impresses the sand and through its central hole an iron nail is driven into the ground to mark a hole. These being achieved, tiles 12 are easily put in place and fixed in the ground by plastic nails 15, FIGS. 7, 8. The plastic nail 15 is notched by a series of elastic blades, which will clamp the nail into the plastic ground. About 4" to the borders the tiles 12 are cut to reach the shape of the covered plane. About 1" to the margin, the tile channels are filled with synthetic resin 13, FIG. 7, and all seams between tiles and stripes are taped with 1½" wide masking tape 14, FIGS. 7, 8. To complete the vacuum network system, the separator 22, FIGS. 5, 6, and the vacuum pump 23, FIG. 5 are connected to pipe 8 as in FIG. 5. This vacuum system will be used for installation of the liner and whenever the pool must be drained. The vinyl liner 16, FIG. 7 is installed as usual. The vacuum air gets into the vacuum system by the holes 30, perforated through the drain parts 18, FIG. 9. The gate valves 9, FIG. 4, separate the different planes of the pool bottom in case the vinyl liner is broken somewhere. To have a clean pavement and a carefully rigging up of the tiles, the head of the nails 15, FIGS. 7, 8, must be at the same level as the tiles. So, when the nail 15, FIGS. 7, 8, has ½" to reach its place, it is cleaned by blowing the hole with compressed air. To have a clean vacuum system it is necessary to clean the paved pool bottom using a household vacuum before installing the vinyl liner 16, FIG. 7. The separator 22, FIGS. 5, 6, is necessary when the pool is filled. If the liner is broken, it is possible to detect the place of deficiency by seeing the water level in the glass tube 27, FIG. 6, and handling the gate valves 9, FIG. 4. When the separator becomes full of water, the gate valves 24, 25, FIG. 6, are closed and the gate valve 26 allows the water out.

I claim:

1. A vacuum system for swimming pools having a vinyl liner, comprising in combination: a vacuum network installed beneath the bottom and around a swimming pool connecting each plane of the pool bottom to an upper surrounding pipe which is further connected to a separator and a vacuum pump; said vacuum network having at least one pipe for each plane of the pool bottom and each said pipe being connected to said upper surrounding pipe by a gate valve; said gate valves being able to separate the different planes of the pool bottom from said upper surrounding pipe; the surface of the pool bottom comprising plastic or rubber tiles having their upper surface impressed with geometrical designs such as squares, hexagons, circles, or any other regular geometrical figure either polygonal or curvilinear spaced enough to allow the movement of vacuum air between them and yet protect the vinyl liner against puncture; said tiles having a central thickened part which has in the middle a hole big enough to accommodate a plastic nail for fixing said tile to the ground; said thickened part being impressed like the head of said plastic nail so that when the nail is driven, the upper face of said tile mates exactly with the head of said plastic nail; said plastic nail having a series of elastic blades which secure the nail into the ground and consequently fix said tile in place; at least one said tile of each said plane of the pool bottom being connected to said pipe of said vacuum network by means of a first drain pipe and a second drain pipe; said first drain pipe having its top channeled and perforated to allow the air to flow from between the vinyl liner and tile surface into the vacuum network, its exterior being smooth on the upper part and provided with blades on the bottom part; said second drain pipe having inside, at its upper part two or more circular channels capable of receiving ring gaskets, at its lower part two or more circular rigid ribs, and at its bottom a flange for connecting to said pipe; said upper part of said first drain pipe mating with said hole of said tile and engaging said ring gaskets; said lower part of said first drain pipe fitting with said rigid ribs; said first drain pipe and said second drain pipe being able to provide a flexible and air-tight connection between said tile and said pipe; smooth strips of Styrofoam or Foaming-rubber being placed at each corner and edge of said pool bottom to separate said planes of the pool bottom; all seams between said tiles and said smooth strips being taped with wide masking tape; and all impressions in said tiles under said masking tape being filled with synthetic resin.

2. A vacuum system for swimming pools as defined in claim 1, in which: the vacuum pump is connected when the liner has to be installed; the separator with the vacuum pump are connected whenever the swimming pool has to be emptied.

* * * * *